US007234953B2

(12) United States Patent
Chen

(10) Patent No.: US 7,234,953 B2
(45) Date of Patent: Jun. 26, 2007

(54) EJECTING DEVICE FOR POWER SOCKET

(76) Inventor: Ta-Yu Chen, No. 196, Fuxing St., Guishan Shiang, Taoyuan County 333 (TW)

( * ) Notice: Subject to any disclaimer, the term of this patent is extended or adjusted under 35 U.S.C. 154(b) by 0 days.

(21) Appl. No.: 11/366,577

(22) Filed: Mar. 3, 2006

(65) Prior Publication Data

US 2006/0211289 A1 Sep. 21, 2006

(51) Int. Cl.
*H01R 13/62* (2006.01)

(52) U.S. Cl. ..... 439/160; 439/152

(58) Field of Classification Search ..... 439/152, 439/159, 160

See application file for complete search history.

(56) References Cited

U.S. PATENT DOCUMENTS

| | | | | |
|---|---|---|---|---|
| 6,062,883 | A * | 5/2000 | Schreiber et al. | 439/159 |
| 6,482,020 | B1 * | 11/2002 | Yeh | 439/159 |
| 6,554,627 | B1 * | 4/2003 | Chen | 439/159 |
| 6,746,256 | B1 * | 6/2004 | Wang | 439/159 |
| 6,773,280 | B2 * | 8/2004 | Sasaki et al. | 439/159 |
| 6,817,874 | B2 * | 11/2004 | Okabe | 439/157 |

* cited by examiner

*Primary Examiner*—Thanh-Tam Le
(74) *Attorney, Agent, or Firm*—Troxell Law Office, PLLC

(57) ABSTRACT

When a power plug is plugged into a power socket, an ejecting device of the present invention is used to easily unplug the power socket. The ejecting device ejects the power plug by using a spring with its elasticity, by using gears with a moving member, or by using a lever-shaped pushing member.

3 Claims, 9 Drawing Sheets

EJECTING DEVICE FOR POWER SOCKET

FIELD OF THE INVENTION

The present invention relates to an ejecting device; more particularly, relates to ejecting a power plug from a power socket.

DESCRIPTION OF THE RELATED ART

In a modern life, we use electric equipments almost in every field. So, power socket is definitely a must in our daily life. We plug a power plug of an equipment into a power socket to obtain electricity for the equipment to function.

Generally speaking, when using a power plug, especially one plugged in a power socket, a user has to use both his/her hands to unplug it. That is, one hand is used to hold the power socket firmly, while the other hand is used to pull out the power plug, which is laborious and inconvenient. Consequently, for those user who has only one hand available, such as some of the disabled, the hand-injured, the old or the sick, it is not easy to unplug the power plug.

In the other hand, some user may unplugs a power plug in a wrong way, such as pulling the power line with a strong force, so that the copper wire in the power line is apt to be broken and may make the equipment a hazard one. Hence, the prior art does not fulfill users' requests on actual use.

SUMMARY OF THE INVENTION

The main purpose of the present invention is to easily unplug the power plug from the power socket through ejecting the power plug by a spring or by a moving member driven by a gear, a pushing member or a lever when a power plug is plugged in a power socket.

To achieve the above purpose, the present invention is an ejecting device for a power socket. In a first embodiment, the ejecting device comprises a spring, a pressing body and a positioning member, where the ejecting device is located in the power socket; the power socket has a plurality of conductive plates; the pressing body is connected with the spring and has a fixing part with an ejecting part extending out; the fixing part has a heart-shaped channel and the ejecting part is positioned between the conductive plates; the positioning member is fixed on a fixing seat at an end and the other end of the positioning member is located in the channel of the fixing part; and a power plug is moved along a direction to be moved out of the power socket by the ejecting part with an elasticity of the spring.

In a second embodiment, the ejecting device comprises a first gear, a second gear and at least a moving member, where the ejecting device is located in a power socket; at least a part of the first gear is exposed from the power socket; the first gear and the second gear are geared into each other; at least one connecting column is deposed on the second gear and is located at an end of a hollow part of the moving member; and the second gear is moved by the first gear to move the power plug a long a direction to be moved out of the power socket with the moving member.

In a third embodiment, the ejecting device comprises a first pushing member and at least a second pushing member, where the ejecting device is located in a power socket; at least a part of the first pushing member is exposed from said power socket; the first pushing member and the second pushing member is fixed to a linkage; and the first pushing member is pushed to move the second pushing member so that the power plug is moved along a direction to be moved out of the power socket.

In a fourth embodiment, the ejecting device comprises a positioning body, at least a protruding ear, an axle and a lever, where the ejecting device is deposed on a power socket; the positioning body is fixed on the power socket; the protruding ear is extended beyond the positioning body; the axle is penetrated through the protruding ear; the lever is composed together with the axle; the lever has a first end and a second end; the first end and the second end are located at two opposite ends of the lever respectively; and the second end of the lever moves upwardly with a rolling of the axle by pushing down the first end of the lever to eject the power plug out of the power socket.

Accordingly, a novel ejecting device for a power socket is obtained.

BRIEF DESCRIPTION OF THE DRAWINGS

The present invention will be better understood from the following detailed descriptions of the preferred embodiments according to the present invention, taken in conjunction with the accompanying drawings, in which.

DESCRIPTION OF THE PREFERRED EMBODIMENTS

The following descriptions of the preferred embodiments are provided to understand the features and the structures of the present invention.

Figure 1:
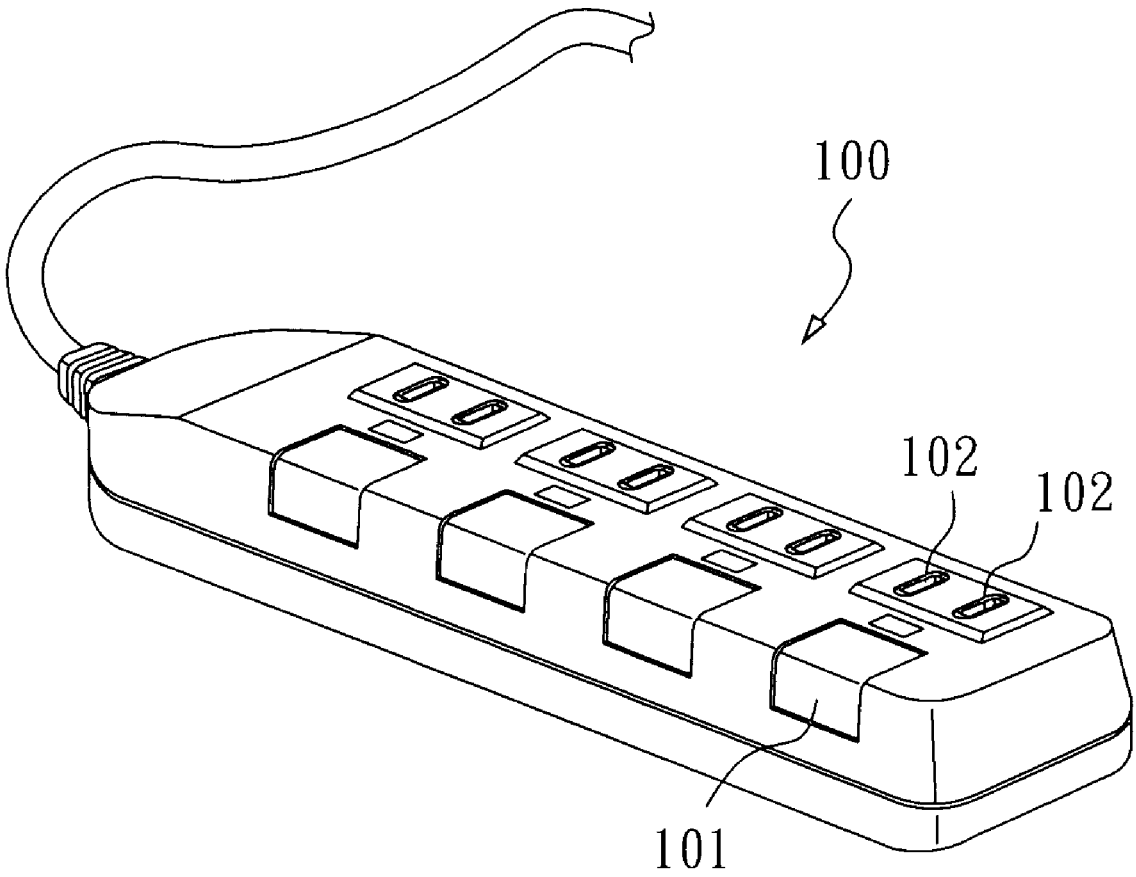
FIG. 1 is a perspective view showing the application to an extended power line according to the present invention.

Please refer to FIG. 1, which is a perspective view showing the application to a power socket according to the present invention. As shown in the figure, the present invention is an ejecting device applied to a power socket 100, where socket holes 102 are to be plugged with power plugs 99 (as shown in FIG. 3A); the socket holes 102 are flat, or round (not shown in the figure); and, the power socket 100 can be a 3-pole socket (not shown in the figure) or a socket on a wall (not shown in the figure).

Figure 2:
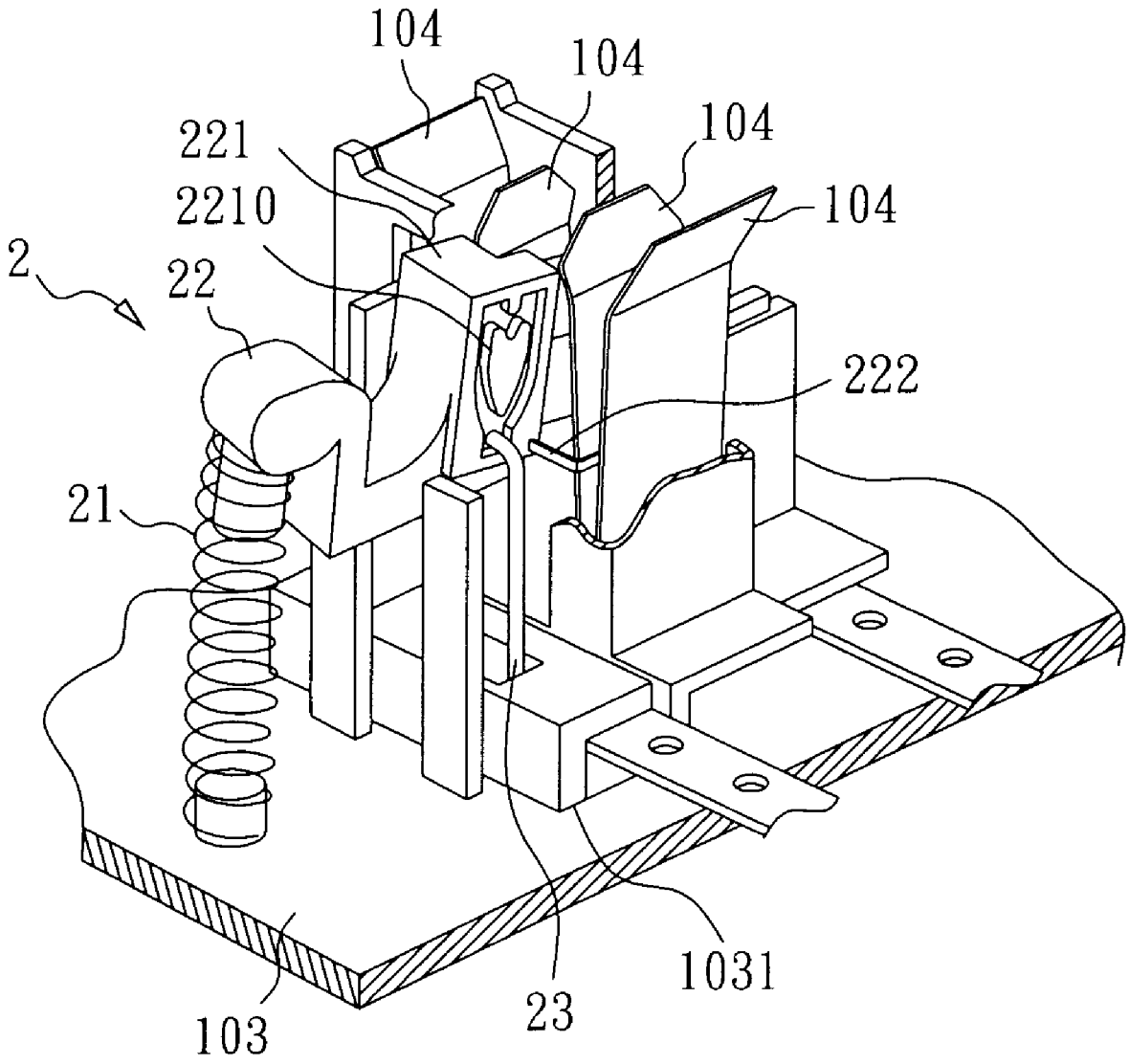
FIG. 2 is a structural view showing the first embodiment.

Please refer to FIG. 2, which is a structural view showing the first embodiment. As shown in the figure, the present invention is an ejecting device 2 applied to a power socket 100, comprising a spring 21, a pressing body 22 and a positioning member 23, wherein the pressing body 22 is connected with the spring 21 and the spring 21 is deposed at bottom 103 of the power socket.

Figure 3A:
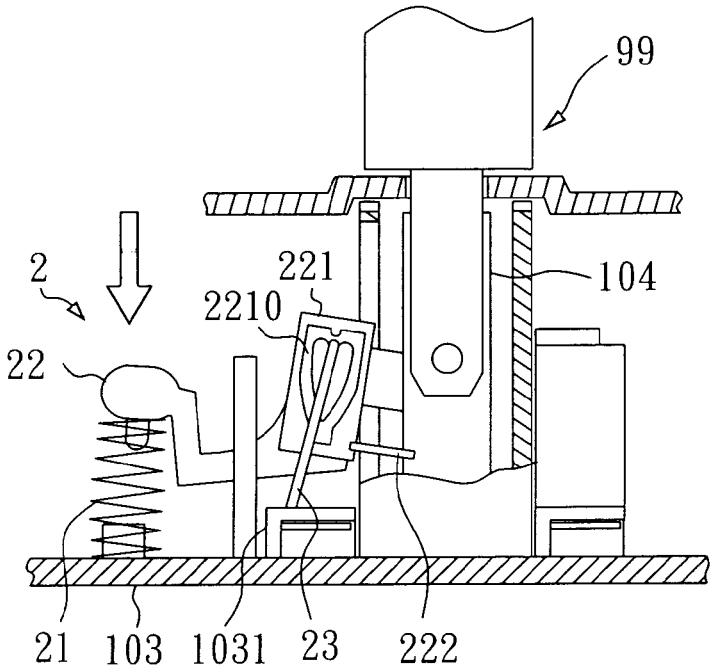
FIG. 3A and FIG. 3B are views showing the state of use.
Figure 3B:
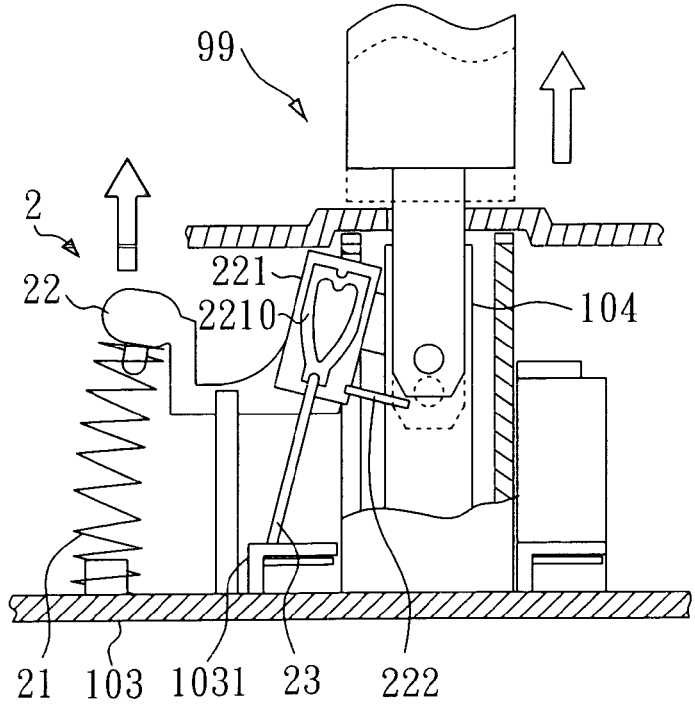

Please further refer to FIG. 3A and FIG. 3B, which are views showing the state of use. As shown in the figure, when a power plug 99 is plugged in a power socket 100 (as shown in FIG. 1), a user pushes a button 101 (as shown in FIG. 1) with finger to move the button 101 downwardly following with a moving down of the pressing body 22. The pressing body 22 has a fixing part 221 with at least one ejecting part 222 extending out: and, the fixing part 221 has a heart-shaped channel 2210. The positioning member 23 is fixed on a fixing seat 1031 at an end; and the other end of the fixing seat 1031 is positioned in the channel 2210. When the pressing body 22 is pressed downwardly, the fixing part 221 moves downwardly too. With the changes in the correlated positions of the positioning member 23 and the channel 2210 done by the moving of the channel 2210, the positioning member 23 slides along the channel 2210 until being in touch with the top rim of the channel 2210. After the button 101 is released by the user, the pressing body 22 moves upwardly by the upward elasticity of the spring 21. The positioning member 23 moves along the channel 2210 to a concave position at the upper part of the channel 2210; then, as the fixing part 221 is fixed with the positioning member 23, the fixing part 221 is stopped being moved upwardly. At this moment, the ejecting part 222 of the pressing body 22 is located at a certain distance below the power plug 99. Therein, the power plug 99 has at least two sets of conductive plates 104; so, two corresponding ejecting parts 222 can be set.

When the user unplugs the power plug 99, the button 101 is pushed again so that, with the changes in the correlated positions of the positioning member 23 and the channel 2210, the positioning member 23 touches the top rim of the channel 2210 at first owing to the moving of the channel 2210 After the user releases the button 101, by the upward elasticity of the spring 21, the pressing body 22 moves upwardly. Then the positioning member 23 moves along the channel 2210 to the bottom of the channel 2210, as shown in FIG. 3B. At the same time, the ejecting part 222 is carried to move upwardly to move the power plug 99 toward a direction to be moved out of the power socket 100.

Figure 4A:
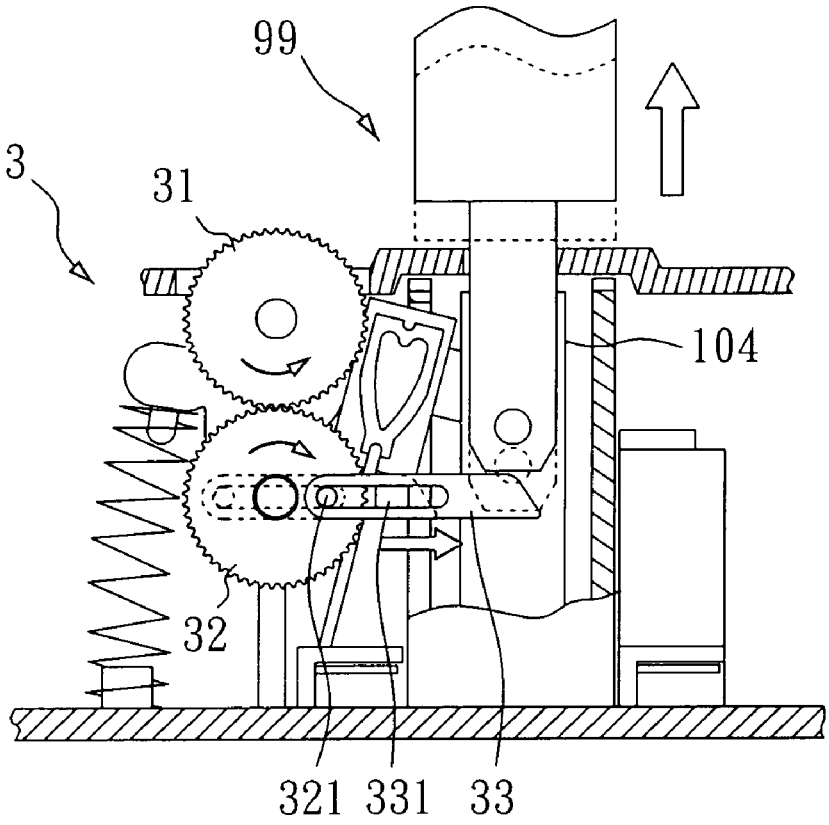
FIG. 4A is a structural view showing the second embodiment.

Please refer to FIG. 4A, which is a structural view showing the second embodiment. As sown in the figure, the present invention is an ejecting device 3 for a power socket 100, comprising a first gear 31, a second gear 32 and at least one moving member 33, where at least one second gear 32 is deposed on a connecting column 321; at least a part of the first gear 31 is exposed from the power socket 100 (as shown in FIG. 1); and the first gear 31 and the second gear 32 are geared into each other.

When the user unplugs the power plug 99, the first gear 31 is rotated (clockwise as shown in FIG. 4) to move the second gear 32. Therein, the moving member 33 has a hollow part 331; and, the connecting column 321 is deposed at an end of the hollow part 331 of the moving member 33. When the second gear 32 rotates, the moving member 33 is carried by the connecting column 321; and further moves the power plug 99 with the moving member 33 toward a direction to be moved out of the power socket 100.

Figure 4B:
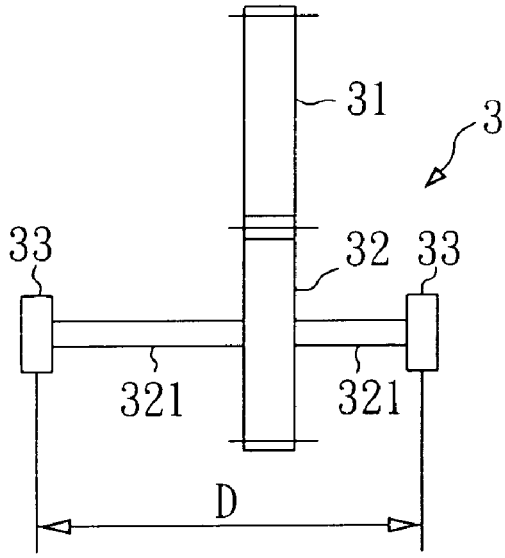
FIG. 4B is a view showing the gears, the linkage and the pushing members.

Please further refer to FIG. 4B which is a view showing the gears, the linkage and the pushing members. As shown in the figure, a power plug 99 has at least two conductive plate 104 (as shown in FIG. 2) so that two corresponding moving members 33 can be set. With a design of the length of the connecting column 321, the separation D between two moving members 33 is as wide as that between the two conductive plates of a power plug 99.

Figure 5A:
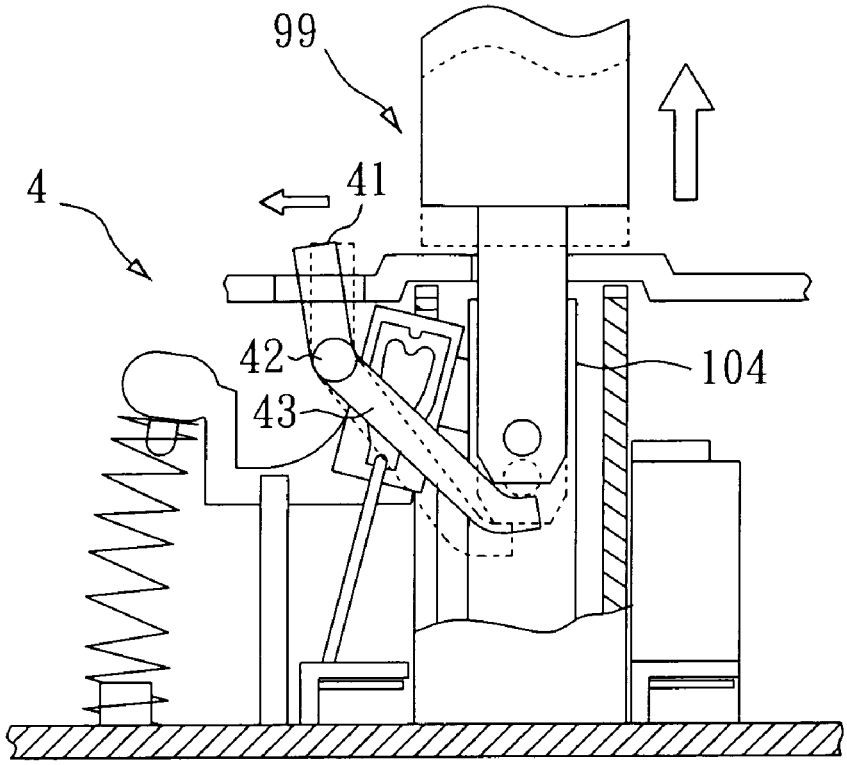
FIG. 5A is a structural view showing the third embodiment.

Please refer to FIG. 5A, which is a structural view showing the third embodiment. As shown in the figure, the present invention is an ejecting device 4 for a power socket 100, comprising a first pushing member 41 and at least one second pushing member 43, where at least a part of the first pushing member 41 is exposed from the power socket 100 (as shown in FIG. 1) and the first pushing member 41 and the second pushing member 43 are fixed on a linkage 42.

When a user unplugs a power plug 99 from the power socket 100, the power plug 99 is moved toward a direction to be moved out of the power socket 100 by pushing the first pushing member 41 to move the second pushing member 43 according to lever theorem.

Figure 5B:
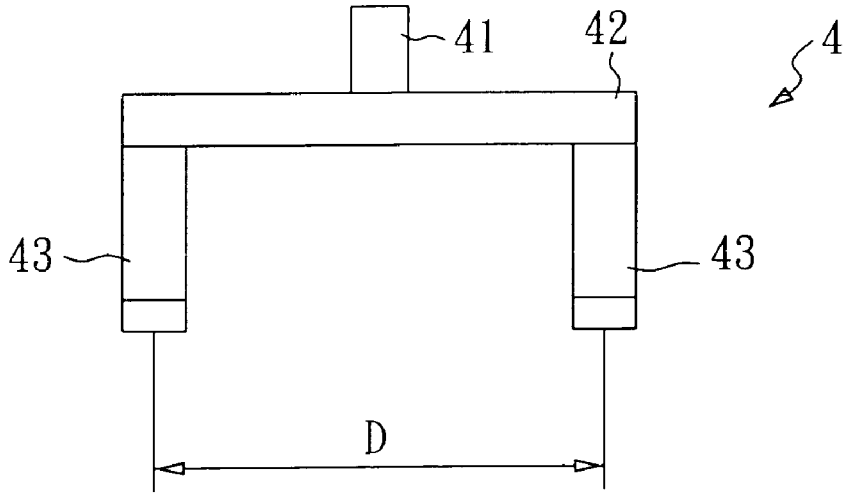
FIG. 5B is a view showing the first pushing member, the linkage and the second pushing member.

Please further refer to FIG.5B, which is a view showing the first pushing member, the linkage and the second pushing member. As shown in the figure, a power plug 99 has at least two conductive plate 104 so that two corresponding second pushing member 43 can be set. With a design of the length of the linkage 42, the separation D between two second pushing members 43 is as wide as that between the two conductive plates of a power plug 99.

Thus, as shown in FIG. 1, FIG. 2, FIG. 4A and FIG. 5A, because a power socket 100 has at least two conductive plate 104, a power plug 99 is electrically connected with the conductive plate 100 by inserting the power plug 99 into the power socket 100. Hence, a current is transferred with a coordination of other electric wires (not shown in the figures). Thus, an ejecting part 222, a moving member 33 or a second pushing member 43 is positioned between the conductive plates 104 to move the power plug 99 along a direction to be moved out of the power socket 100.

Figure 6:
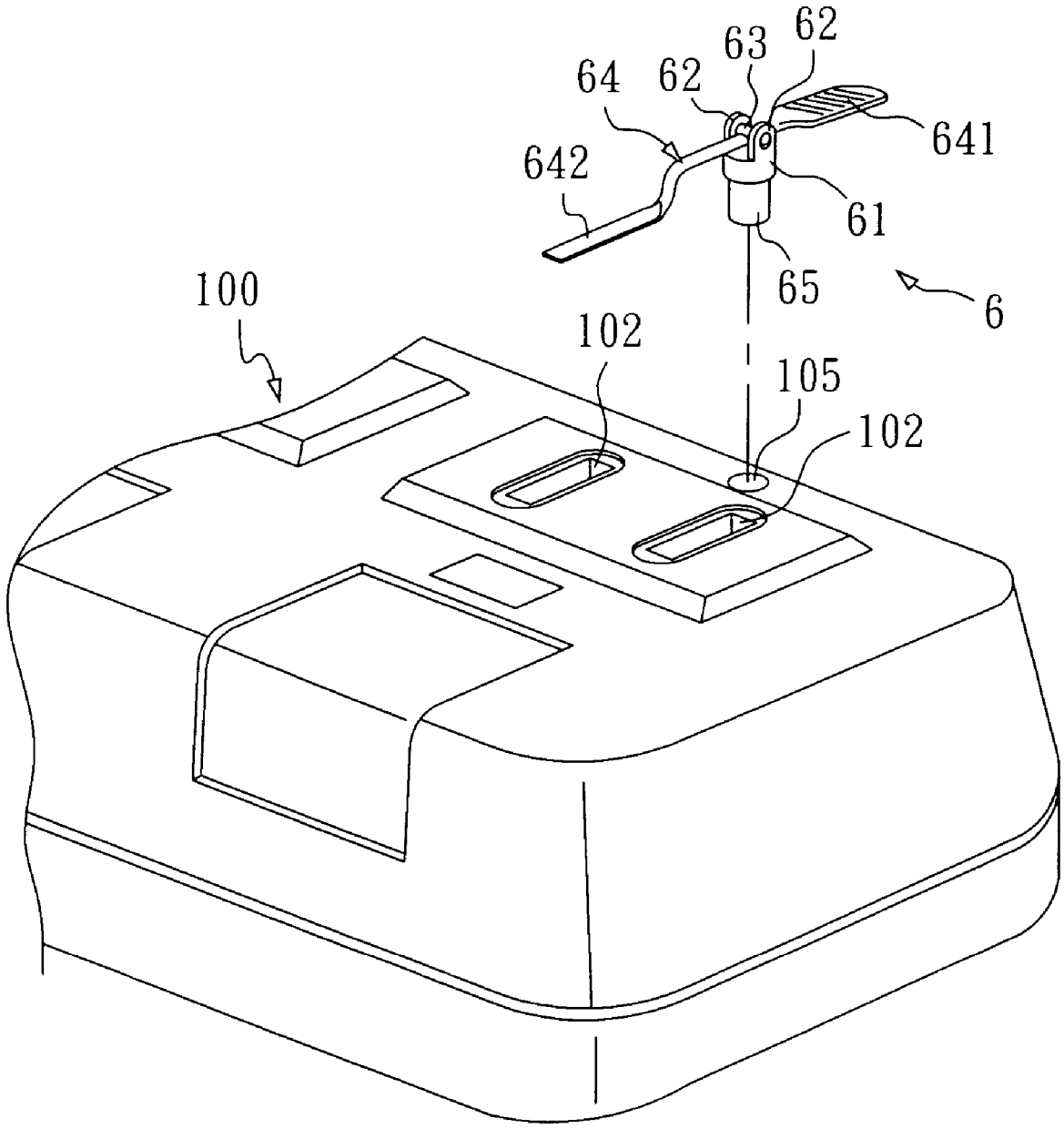
FIG. 6 is a structural view showing the fourth embodiment.

Please refer to FIG. 6, which is a structural view showing the fourth embodiment. As shown in the figure, the present invention is an ejecting device 6 applied on the outside of a power socket 100, comprising a positioning body 61, two protruding ears 62, an axle 63 and a lever 64. The positioning body 61 is fixed on the power socket 100 with a positioning column 65 extending out. The positioning column 65 is inserted into a grounding hole 105 of the power socket 100 to fix the ejecting device 6 on the power socket 100. The lever 64 is constructed with the axle 63; and the lever 64 and the axle 63 are formed into a whole, or are connected pivotally. The protruding ears 62 is extended beyond the positioning body 61; and, the axle 63 is penetrated through the protruding ears 62. The lever 64 has a first end 641 and a second end 642, where the first end 641 and the second end 642 are located at two opposite ends of the lever 64.

Figure 7:
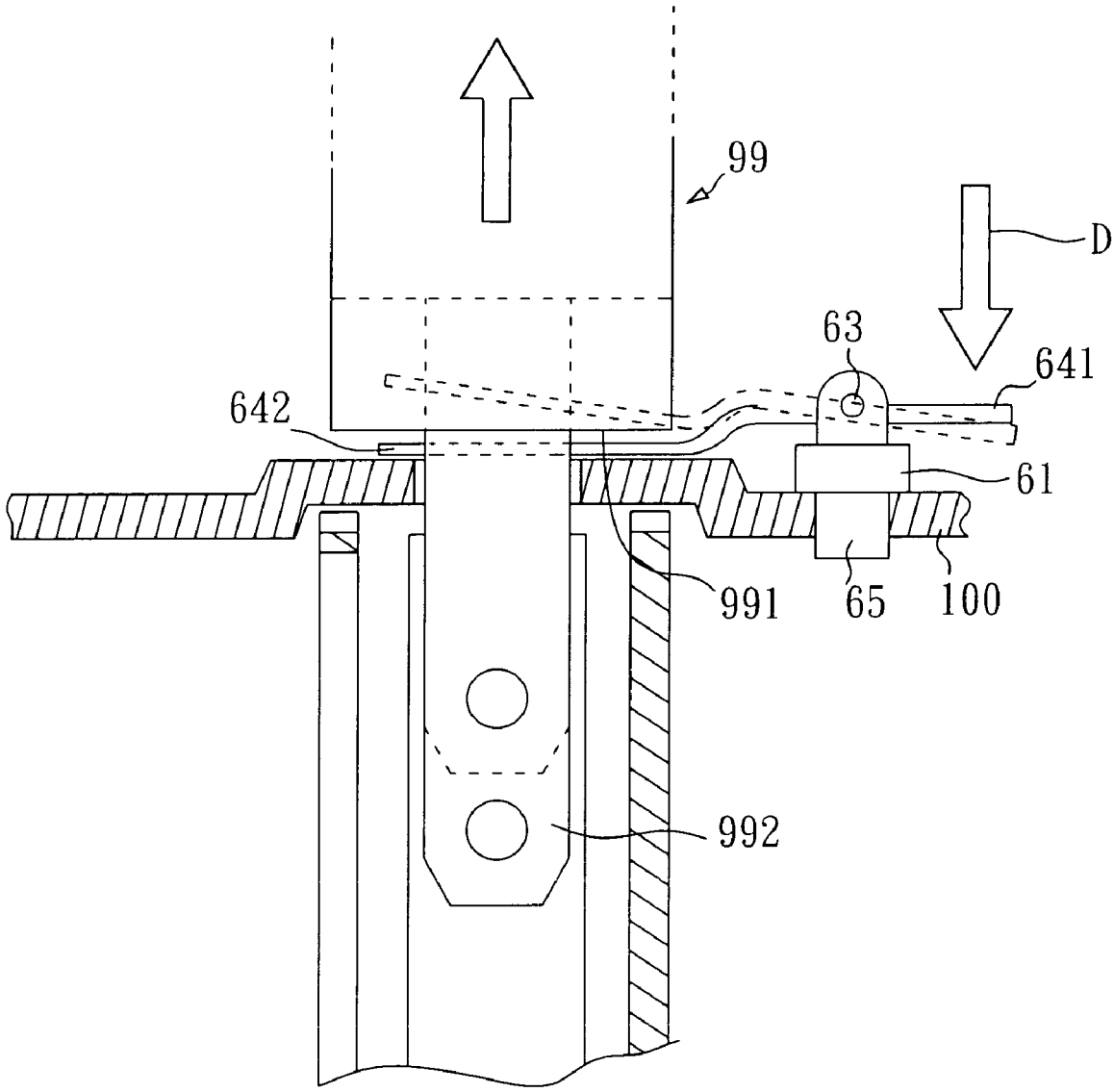
FIG. 7 is a view showing the first state of use.

Please further refer FIG. 7, which is a view showing the first state of use As shown in the figure, when the power plug 99 is ejected from the power socket 100 by using the ejecting device 6, the first end 641 of the lever 64 is pushed down along a direction as arrow D shows. Then, by a rolling of the axle 63, the second end 642 of the lever 64 moves upwardly based on lever theorem The second end 642 is positioned between two plug contactors 992 of the power plug 99, or at the rim 991 of the power socket 100. Thus, when the second end 642 of the lever 64 moves upwardly, the power plug is moved along a direction to be moved out of the power socket 100. Therein, for easily ejecting the power plug 99 from the power socket 100, the lever 64 is bended; and, the second end 642 is flat to be completely positioned in between the power plug 99 and the power socket 100.

Figure 8:
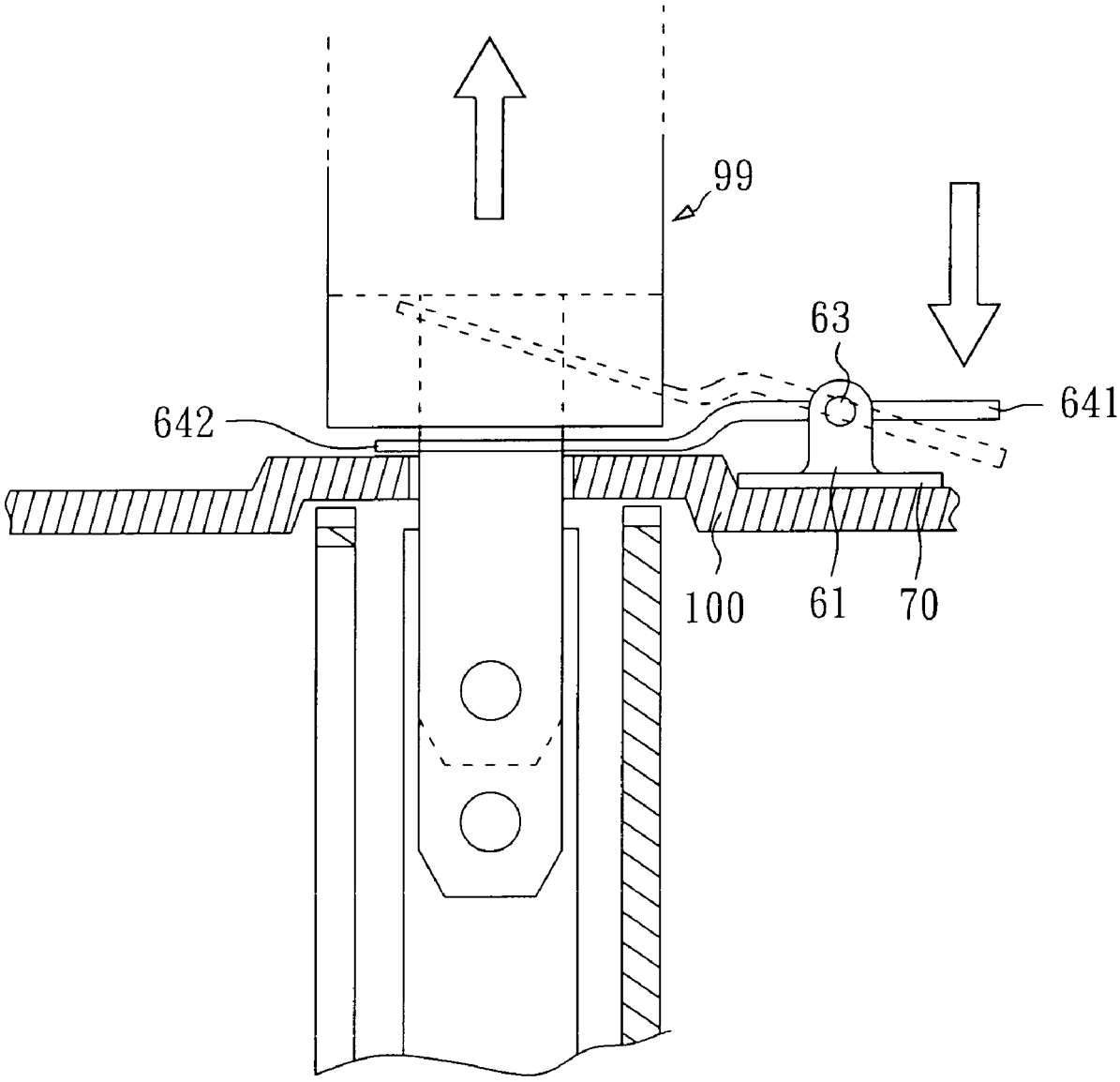
FIG. 8 is a view showing the second state of use.

Please refer to FIG. 6 and FIG. 8, which are a structural view showing the fourth embodiment and a view showing the second state of use. As shown in the figures, the fourth embodiment is adhered on a power socket 100 by a positioning body 61 with an adhering member 70, such as a twin adhesive; or, the positioning body 61 and the power socket 100 can be made into a whole.

Figure 9:
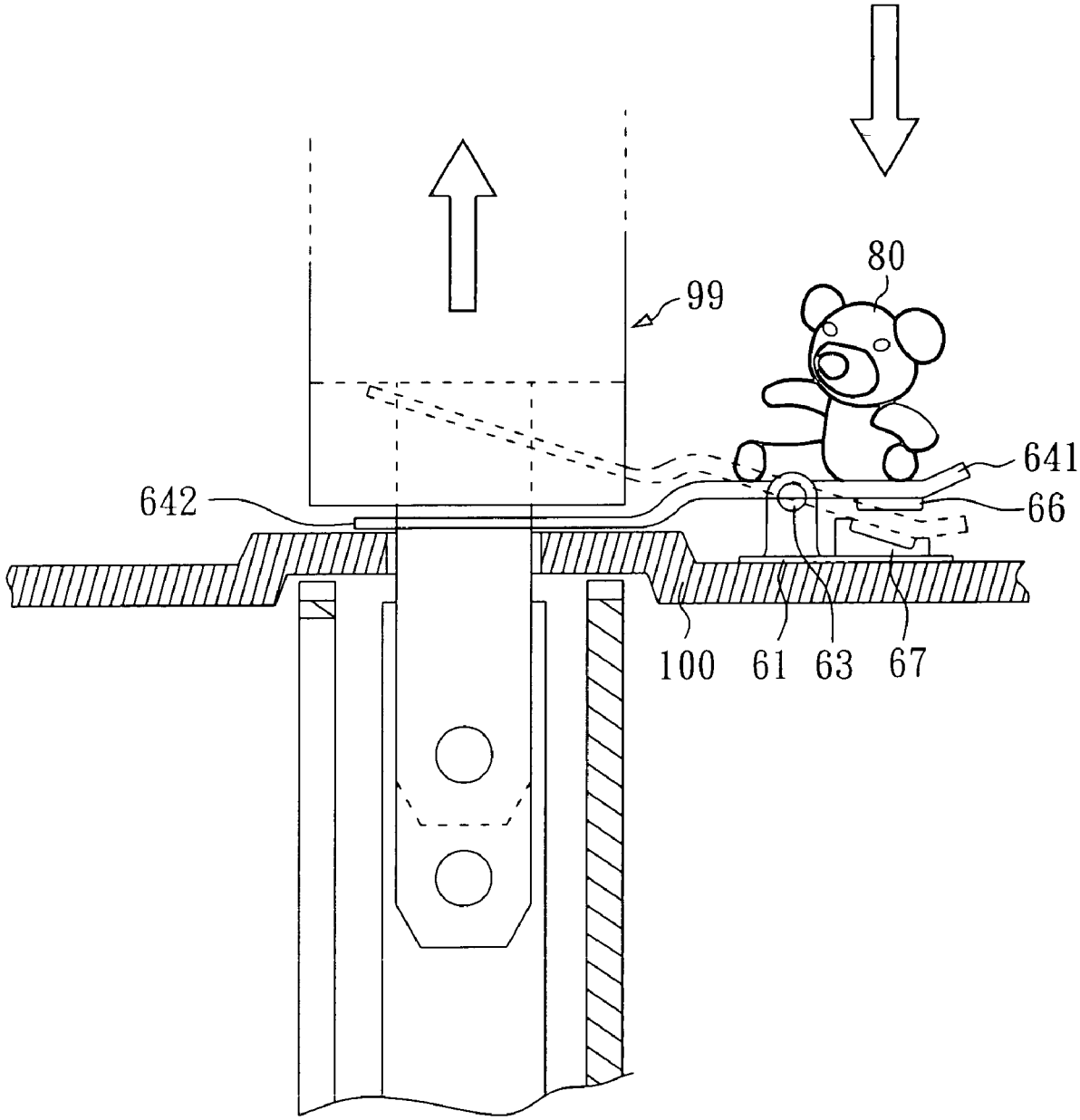
FIG. 9 is a view showing the third state of use.

Please refer to FIG. 6 and FIG. 9, which are a structural view showing the fourth embodiment and a view showing the third state of use. As shown in the figure, a fourth embodiment has a fixing member 67; and, a first end 641 of a lever 64 is locked to the fixing member 67. A locking member 66 corresponding to the fixing member 67 is deposed on the first end 641 of the lever 64 so that, when the first end 641 is pushed downwardly, the locking member 66 is right locked into the fixing member 67. Therein, the fixing member 67 and the positioning body 61 can be made into a whole. Moreover, in order to attract a user, the first end 641 can have a decoration 80, which not only adds beauty but also can be directly pushed down by the user.

To sum up, the present invention is an ejecting device for a power socket, where a power plug can be easily unplugged without causing any electrical problem by pulling a power line. For those disabled or injured people who are inconvenient in unplugging a power plug with two hands, the present invention provides a labor-saving device to easily eject a power plug from a power socket.

The preferred embodiments herein disclosed are not intended to unnecessarily limit the scope of the invention. Therefore, simple modifications or variations belonging to the equivalent of the scope of the claims and the instructions disclosed herein for a patent are all within the scope of the present invention.

What is claimed is:

1. An ejecting device selectively ejecting a power plug from a power socket, the ejecting device comprising:

a) a pressing body movable between first and second positions and having:

i) an ejecting part extending into the power socket; and ii) a fixing part;

b) a spring engaging the pressing body and pressing the pressing body upwardly; and c) a positioning member connected at a first end to a fixing seat and having a second end located in a channel of the fixing part, and selectively positioning the ejecting part in the first and second positions, wherein, when the pressing body is located in a first position, the pressing body, the ejecting part, and the spring are moved downwardly, the spring being compressed, wherein, when pressing body is located in a second position, the spring moving the pressing body and the ejecting part upwardly, the spring expanding to a normal state, wherein when the power plug is located in the power socket and the pressing body moves from the first position to the second position, the ejecting part engaging the power plug and ejecting the power plug from the power socket;

a button controlling a movement of the pressing body, the button is located on the power socket.

2. The ejecting device according to claim 1, wherein the channel of the fixing part is a heart shaped channel, the second end of the positioning member is located in the heart shaped channel.

3. The ejecting device according to claim 1, wherein the ejecting part is located between a plurality of conductive plates of the power socket and the power plug.

* * * * *